US007477023B2

(12) United States Patent
Shimura et al.

(10) Patent No.: US 7,477,023 B2
(45) Date of Patent: Jan. 13, 2009

(54) INVERTER CIRCUIT AND BACKLIGHT ASSEMBLY HAVING THE SAME

(75) Inventors: Tatsuhisa Shimura, Tokyo (JP); Osamu Sengoku, Tokyo (JP)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/851,743

(22) Filed: Sep. 7, 2007

(65) Prior Publication Data

US 2008/0061709 A1 Mar. 13, 2008

(30) Foreign Application Priority Data

Sep. 8, 2006 (KR) ..... 10-2006-0086971

(51) Int. Cl.
*H05B 41/16* (2006.01)

(52) U.S. Cl. ..... 315/282; 315/291; 315/209 R; 315/277; 315/278; 315/224; 315/324

(58) Field of Classification Search ..... 315/209 R, 315/246, 276–279, 285, 291, 224, 282, 312, 315/324; 336/82, 83, 170, 173, 192, 213, 336/214, 221, 222

See application file for complete search history.

(56) References Cited

U.S. PATENT DOCUMENTS

| | | | | |
|---|---|---|---|---|
| 7,061,183 | B1 * | 6/2006 | Ball | 315/57 |
| 7,365,501 | B2 * | 4/2008 | Ushijima et al. | 315/278 |
| 7,402,957 | B2 * | 7/2008 | Shimura et al. | 315/276 |
| 2003/0141829 | A1 | 7/2003 | Yu et al. | |

FOREIGN PATENT DOCUMENTS

| | | |
|---|---|---|
| JP | 2005317253 | 11/2005 |
| KR | 1020060028018 | 3/2006 |

* cited by examiner

*Primary Examiner*—Haissa Philogene
(74) *Attorney, Agent, or Firm*—Cantor Colburn LLP

(57) ABSTRACT

An inverter circuit includes a power supply which outputs an alternating current voltage, an inverter transformer having one primary coil connected to an output terminal of the power supply and pairs of secondary coils which supply an alternating current high voltage, induced by the one primary coil, to pairs of discharge tubes and a plurality of balance transformers having primary coils serially connected between respective pairs of the pairs of secondary coils of the inverter transformer, and having secondary coils corresponding to the primary coils of the plurality of balance transformers, wherein the secondary coils of the plurality of balance transformers are serially connected to form a loop.

20 Claims, 12 Drawing Sheets

INVERTER CIRCUIT AND BACKLIGHT ASSEMBLY HAVING THE SAME

This application claims priority to Korean Patent Application No. 2006-86971, filed on Sep. 08, 2006, and all the benefits accruing therefrom under 35 U.S.C. §119, the contents of which in its entirety are herein incorporated by reference.

BACKGROUND OF THE INVENTION

1. Field of the Invention

The present invention relates to an inverter circuit and a backlight assembly having the same, capable of lighting a plurality of discharge tubes such as cold cathode fluorescent lamps ("CCFLs") used for a light source of a liquid crystal display ("LCD") device.

Although a discharge tube described below mainly represents a CCFL, the present invention is not limited to the CCFL, but adaptable for a system which turns on/off a plurality of discharge tubes in response to an alternating current ("AC") high voltage. In addition, the discharge tube is not limited to the CCFL.

2. Description of the Related Art

Conventional LCD devices are required to be fabricated having a light weight and compact size while operating with low power consumption. Since the LCD devices are non-emissive devices, a light source must be employed in the LCD device. Typically, a CCFL is used as the light source.

The CCFL is a type of a fluorescent lamp which operates in a regular glow discharge region. An AC high voltage is applied to the CCFL such that the CCFL is illuminated. Since the CCFL is not preheated by a filament, the CCFL has a relatively higher vibration-resistant property, a thinner diameter and a longer life span as compared with those of a hot cathode fluorescent lamp. In addition, since the CCFL is not preheated by a filament, a high voltage must be applied to the CCFL in order to operate.

An inverter circuit is used to generate the AC high voltage used to turn on/off the CCFL.

As shown in FIG. 12, the conventional inverter circuit of the prior art includes first and second inverters 11 and 12, first and second inverter transformers 13 and 14, which belong to a first group, first and second inverter transformers 15 and 16, which belong to a second group and first and second current detection transformers 17 and 18, in order to turn on/off a plurality of CCFLs.

The first and second inverters 11 and 12 control output signals based on a current detection value fedback from the first and second current detection transformers 17 and 18. The first inverter transformer 13, belonging to the first group, has one primary coil 13*a* connected to an output terminal of the first inverter 11 and two pairs of secondary coils 13*b*, 13*c*, 13*d* and 13*e* corresponding to the primary coil 13*a*. The primary coil 13*a* induces an AC high voltage in the two pairs of secondary coils 13*b*, 13*c*, 13*d* and 13*e* and the two pairs of secondary coils 13*b*, 13*c*, 13*d* and 13*e* apply the AC high voltage to the two pairs of the CCFLs 120 connected thereto.

The second inverter transformer 14, belonging to the first group, has one primary coil 14*a* connected to an output terminal of the first inverter 11 and two pairs of secondary coils 14*b*, 14*c*, 14*d* and 14*e* corresponding to the primary coil 14*a*. The primary coil 14*a* induces an AC high voltage in the two pairs of secondary coils 14*b*, 14*c*, 14*d* and 14*e* and the two pairs of secondary coils 14*b*, 14*c*, 14*d* and 14*e* apply the AC high voltage to the two pairs of the CCFLs 120 connected thereto.

The first current detection transformer 17 has one primary coil 17*a* serially connected to one pair of the secondary coils 14*d* and 14*e* of the second inverter transformer 14, belonging to the first group. The first current detection transformer 17 has a secondary coil 17*b* which is connected between the first inverter 11 and a ground GND so as to create a current detection value and provide the current detection value to the first inverter 11.

The first inverter transformer 15, belonging to the second group, has one primary coil 15*a* connected to an output terminal of the second inverter 12 and two pairs of secondary coils 15*b*, 15*c*, 15*d* and 15*e* corresponding to the first primary coil 15*a*. The primary coil 15*a* induces an AC high voltage in the two pairs of secondary coils 15*b*, 15*c*, 15*d* and 15*e* and the two pairs of secondary coils 15*b*, 15*c*, 15*d* and 15*e* apply the AC high voltage to the two pairs of CCFLs 120 connected thereto.

The second inverter transformer 16, belonging to the second group, has one primary coil 16*a* connected to the output terminal of the second inverter 12 and two pairs of secondary coils 16*b*, 16*c*, 16*d* and 16*e* corresponding to the first primary coil 16*a*. The primary coil 16*a* induces an AC high voltage in the two pairs of secondary coils 16*b*, 16*c*, 16*d* and 16*e* and the two pairs of secondary coils 16*b*, 16*c*, 16*d* and 16*e* apply the AC high voltage to the two pairs of CCFLs 120 connected thereto.

The second current detection transformer 18 has a primary coil 18*a* serially connected to one pair of the secondary coils 16*d* and 16*e* of the second inverter transformer 16, belonging to the second group. In addition, the second current detection transformer 18 has a secondary coil 18*b* connected between the second inverter 12 and the ground GND so as to create a current detection value and provide the current detection value to the second inverter 12.

Further, a tube-current equilibrium circuit having the conventional inverter circuit of the prior art is disclosed in Japanese Patent Unexamined Publication No. 2005-317253. Referring to Japanese Patent Unexamined Publication No. 2005-317253, the tube-current equilibrium circuit includes a plurality of discharge tubes connected to each other in parallel to serve as loads of the inverter circuit, and balance coils which equalize tube current of the discharge tubes. The discharge tube is a CCFL representing an equivalent resistance value of 50 KΩ or more when current flows therethrough. The balance coil includes two coils having the same number of windings, and a self resonant frequency of the balance coil is 1.5 times an operational frequency of an inverter transformer of the inverter circuit.

In the conventional inverter circuit of the prior art, the current flowing through a plurality of CCFLs is not uniform and thus luminance mura occurs due to an impedance mismatching between the CCFLs, mismatching between inverter transformers and a difference in coil ratios of primary coils to secondary coils of the inverter transformers, even if the current of one CCFL is fedback to the inverter.

Further, in the conventional inverter circuit of the prior art, since the CCFLs generally require a relatively high voltage (starting voltage) to operate the CCFLs (discharge tube), if the CCFLs (discharge tubes) connected to secondary coils of inverter transformers coupled with the first and second current detection transformers 17 and 18 are turned on, and some of the CCFLs (discharge tubes) connected to inverters coupled with the above inverter transformers are not turned on, a starting current of the inverter transformer is in a stable state due to the feedback of current. Accordingly, the voltage of the second coils, which are not driven, does not reach the starting voltage, thereby causing some of the CCFLs not to be turned on.

In addition, in the conventional inverter circuit of the prior art, since current detection interconnections are necessary with the secondary coils of the inverter transformer, designs of the secondary coils of the inverter transformer are different from each other, thus disturbing current uniformity in the secondary coils of the inverter transformer.

BRIEF SUMMARY OF THE INVENTION

Therefore, the present invention provides an inverter circuit and a backlight assembly, capable of uniformly maintaining current flowing through pairs of cold cathode fluorescent lamps ("CCFLs"), preventing some of the CCFLs from being turned off and facilitating designing of secondary coils of an inverter transformer since current detection interconnections are not necessary in the secondary coils of the inverter transformer.

The present invention discloses an inverter circuit including a power supply, an inverter transformer and a plurality of balance transformers. The power supply outputs an alternating current voltage. The inverter transformer having one primary coil connected to an output terminal of the power supply and pairs of secondary coils which supply an alternating current ("AC") high voltage, induced by the one primary coil, to pairs of discharge tubes. The plurality of balance transformers having primary coils serially connected between respective pairs of the pairs of secondary coils of the inverter transformer, and having secondary coils corresponding to the primary coils of the plurality of balance transformers.

The secondary coils of the plurality of balance transformers are serially connected to form a loop, and the secondary coils of the plurality of balance transformers which form the loop may be connected to a ground.

The power supply may be provided with a current detection value based on a current value of the secondary coils of the plurality of balance transformers to control an output voltage of the power supply.

The inverter circuit may further comprise a current detection transformer which has a primary coil serially connected to the secondary coils of the plurality of balance transformers and a secondary coil connected to the power supply to provide the current detection value to the power supply.

According to the present invention, a current flowing through the pairs of discharge tubes is uniformly maintained due to an operation of the plurality of balance transformers, and the plurality of balance transformers compensate for a shortage of a starting voltage even if the starting voltage is insufficient in a portion of the two pairs of the cold cathode fluorescent lamps. Accordingly, some of the cold cathode fluorescent lamps are prevented from being turned off. In addition, since current detection interconnections are unnecessary for secondary coils of the inverter transformer, designs of the secondary coils of the inverter transformer may be substantially similar to each other.

BRIEF DESCRIPTION OF THE DRAWINGS

The above and other aspects, features and advantages of the present invention will become readily apparent by reference to the following detailed description when considered in conjunction with the accompanying drawings wherein.

DETAILED DESCRIPTION OF THE INVENTION

Figure 1:
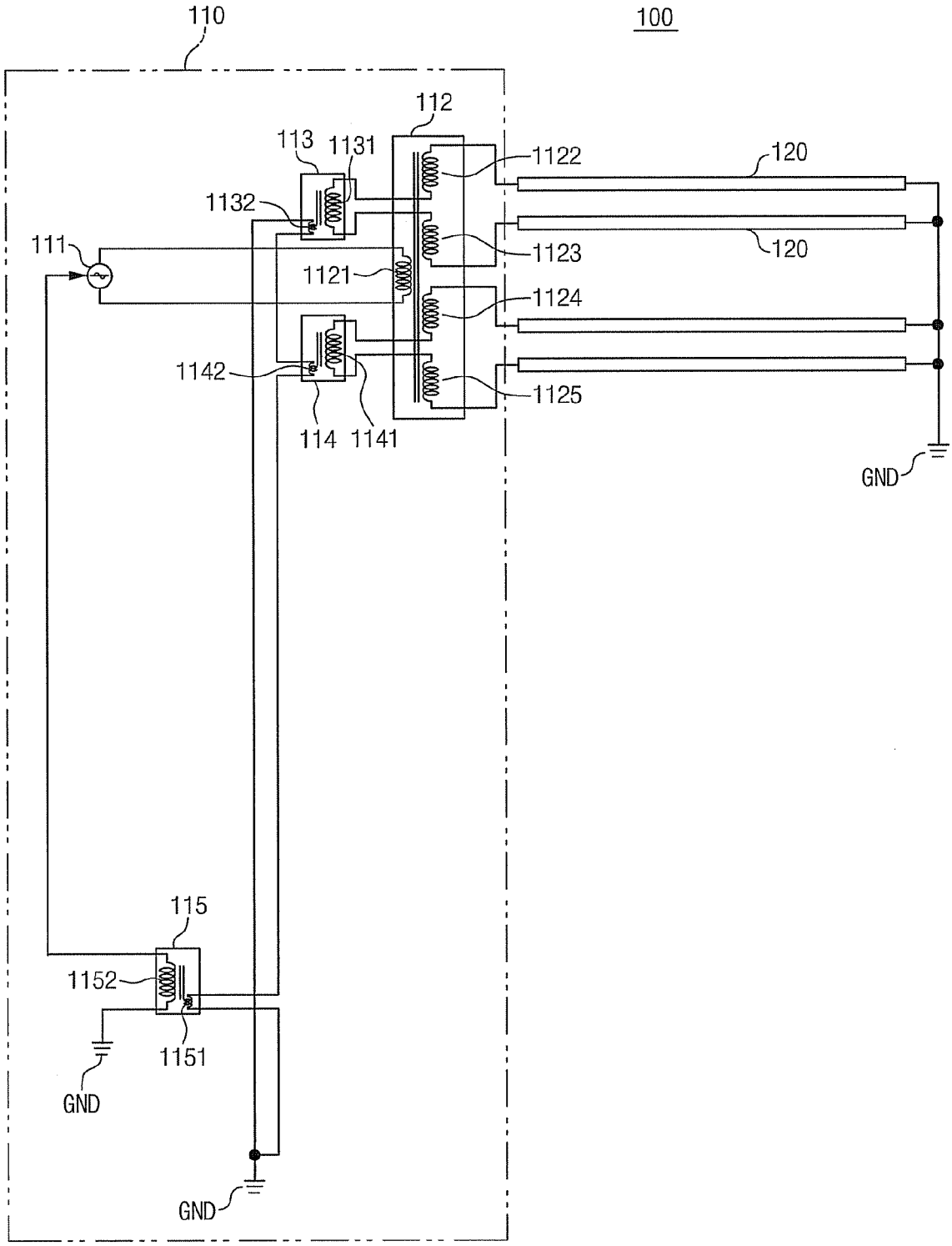
FIG. 1 is a circuit schematic diagram illustrating an exemplary inverter circuit and an exemplary backlight assembly according to a first embodiment of the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in detail with reference to accompanying drawings. However, the scope of the present invention is not limited to such exemplary embodiments and the present invention may be realized in various forms.

FIG. 1 is a circuit schematic diagram illustrating an exemplary inverter circuit 110 and an exemplary backlight assembly 100 according to a first embodiment of the present invention.

Referring to FIG. 1, the backlight assembly 100 includes an inverter circuit 110 and two pairs of cold cathode fluorescent lamps ("CCFLs") (discharge tubes) 120.

The inverter circuit 110 includes one inverter 111, one inverter transformer 112, two balance transformers 113 and 114 and a current detection transformer 115.

The inverter 111 controls an output signal based on a current detection value fedback from the current detection transformer 115. The inverter transformer 112 includes one primary coil 1121 connected to an output terminal of the inverter 111. In addition, the inverter transformer 112 includes two pairs of secondary coils 1122, 1123, 1124 and 1125 connected to first end portions of two pairs of the CCFLs 120. The two pairs of the secondary coils 1122, 1123, 1124 and 1125 of the inverter transformer 112 provide an AC high voltage, which is induced by the primary coil 1121, to the two pairs of CCFLs 120. Second end portions of the two pairs of the CCFLs 120 are connected to a ground GND.

Since the CCFL 120 is driven by a high voltage, static noise radiated from the CCFL 120 is substantial. Accordingly, since the static noise affects a liquid crystal display ("LCD") apparatus, the static noise radiated from the CCFL 120 is canceled by phase-shifting the output of the CCFL 120 by 180 degrees. As shown in FIG. 1, according to the first exemplary embodiment of the present invention, neighboring CCFLs 120 are driven by voltages which are phase-shifted from each other by 180 degrees, respectively, such that the static noise generated from the CCFLs 120 is offset from each other. Accordingly, an influence of the static noises on the LCD apparatus is thereby reduced.

A primary coil 1131 of the balance transformer 113 is serially connected to the secondary coils 1122 and 1123 of the inverter transformer 112. A primary coil 1141 of the balance transformer 114 is serially connected to the secondary coils 1124 and 1125 of the inverter transformer 112.

Secondary coils 1132 and 1142 of the two balance transformers 113 and 114 are serially connected to each other, thereby forming a loop. A portion of the loop formed by the secondary coils 1132 and 1142 of the two balance transformers 113 and 114 is connected to the ground GND.

A primary coil 1151 of a current detection transformer 115 is serially connected to the secondary coils 1132 and 1142 of the two balance transformers 113 and 114. A secondary coil 1152 of the current detection transformer 115 is connected between the inverter 111 and the ground GND. In the secondary coil 1152 of the current detection transformer 115, a value of current induced by the primary coil 1151 of the current detection transformer 115 is transformed into a current detection value which is provided to the inverter 111.

Figure 2:
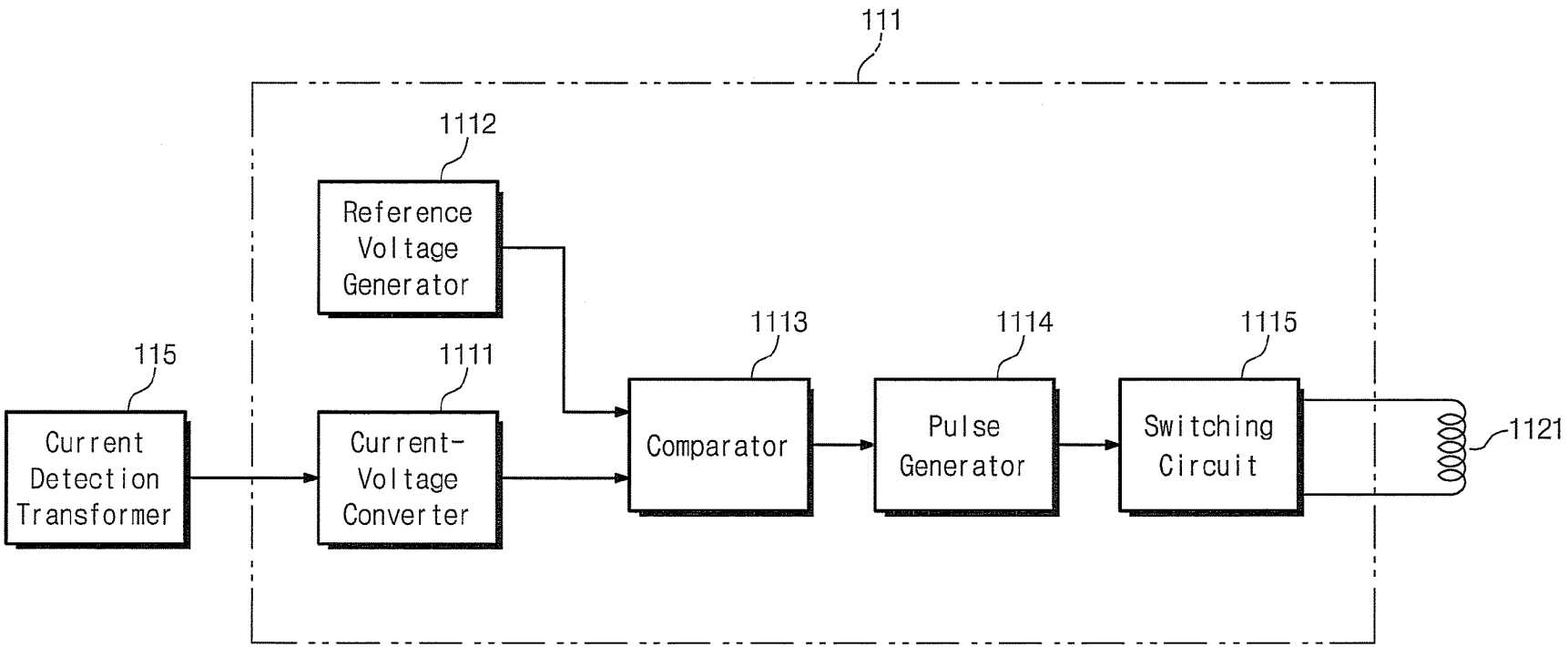
FIG. 2 is a block diagram illustrating a structure of an exemplary inverter according to the first embodiment of the present invention.

FIG. 2 is a block diagram illustrating the exemplary inverter 111 according to the first exemplary embodiment of the present invention.

Referring to FIG. 2, the inverter 111 includes a current-voltage converter 1111, a reference voltage generator 1112, a comparator 1113, a pulse generator 1114 and a switching circuit 1115.

An input terminal of the current-voltage converter 1111 is connected to the secondary coil 1152 of the current detection transformer 115. An output terminal of the current-voltage converter 1111 is connected to a first input terminal of the comparator 1113. An output terminal of the reference voltage generator 1112 is connected to a second input terminal of the comparator 1113.

An output terminal of the comparator 1113 is connected to an input terminal of the pulse generator 1114. An output terminal of the pulse generator 1114 is connected to an input terminal of the switching circuit 1115. An output terminal of the switching circuit 1115 is connected to the primary coil 1121 of the inverter transformer 112.

The current-voltage converter 1111 converts the current detection value output from the current detection transformer 115 into a voltage detection value to provide the voltage detection value to the comparator 1113. The comparator 1113 compares the voltage detection value from the current-voltage converter 1111 with a reference voltage value from the reference voltage generator 1112 and then generates a voltage difference between the voltage detection value and the reference voltage value. The comparator 1113 then provides the voltage difference to the pulse generator 1114.

The pulse generator 1114 generates a pulse signal including a pulse width controlled according to the voltage difference output from the comparator 1113 in order to provide the pulse signal to the switching circuit 1115. The switching circuit 1115 generates an AC voltage based on the pulse signal output from the pulse generator 1114 in order to provide the AC voltage to the primary coil 1121 of the inverter transformer 112.

Since the inverter 111 controls the AC voltage of an output signal based on a current detection value fedback from the current detection transformer 115 serially connected to the secondary coils 1132 and 1142 of the two balance transformers 113 and 114, a proper AC voltage may be provided to the primary coil 1121 of the inverter transformer 112. However, the present invention is not limited to a number of balance transformers 113 and 114 connected to the current detection transformer 115.

According to the first exemplary embodiment of the present invention, current flowing through the two pairs of the CCFLs 120 is uniformly maintained by an operation of the two balance transformers 113 and 114 since the primary coils 1131 and 1141 of the two balance transformers 113 and 114 are serially connected to the secondary coils 1122, 1123, 1124 and 1125 of the inverter transformer 112, the secondary coils 1132 and 1142 of the two balance transformers 113 and 114 are serially connected to each other to thereby form a loop, and the two balance transformers 113 and 114 and the portion of the loop which is connected to the ground GND are employed.

In addition, according to the first exemplary embodiment of the present invention, the two balance transformers 113 and 114 are employed so as to compensate for a shortage of a starting voltage, such that the CCFL 120 may be maintained in a turned on state even if the starting voltage is temporarily insufficient in a portion of the two pairs of the CCFLs 120.

According to the first exemplary embodiment of the present invention, since current detection interconnections are unnecessary for the secondary coils 1122, 1123, 1124 and 1125 of the inverter transformer 112, designs of the secondary coils 1122, 1123, 1124 and 1125 of the inverter transformer 112 may be substantially similar to each other.

Figure 3:
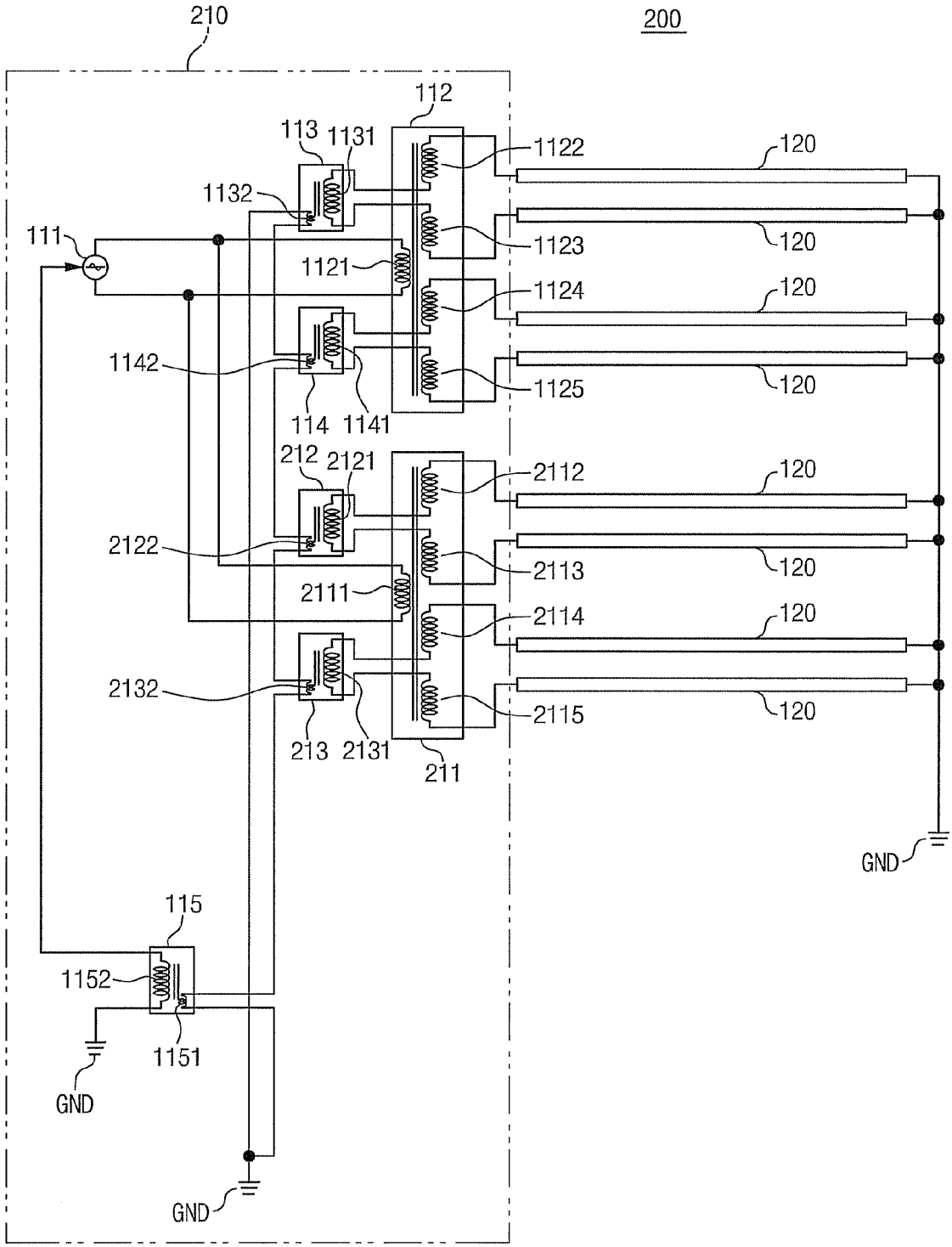
FIG. 3 is a circuit schematic diagram illustrating an exemplary inverter circuit and an exemplary backlight assembly according to a second embodiment of the present invention.

Hereinafter, a second exemplary embodiment of the present invention will be described in detail with reference to accompanying drawings. FIG. 3 is a circuit schematic diagram illustrating an exemplary inverter circuit 210 and an exemplary backlight assembly 200 according to the second exemplary embodiment of the present invention. The same reference numerals will be assigned to the elements identical to the elements shown in the first exemplary embodiment, and detailed description thereof will be omitted in order to avoid redundancy.

Referring to FIG. 3, the backlight assembly 200 includes an inverter circuit 210 and four pairs of CCFLs (discharge tubes) 120.

The inverter circuit 210 includes one inverter 111, two inverter transformers 112 and 211, four balance transformers 113, 114, 212 and 213 and a current detection transformer 115.

The inverter transformer 211 includes one primary coil 2111 connected to an output terminal of the inverter 111. The inverter transformer 211 and the inverter transformer 112 are connected to the inverter 111 in parallel with each other. In addition, the inverter transformer 211 includes two pairs of secondary coils 2112, 2113, 2114 and 2115 connected to first end portions of two pairs of CCFLs 120. In the two pairs of the secondary coils 2112, 2113, 2114 and 2115 of the inverter transformer 211, an AC high voltage is induced by the primary coil 2111, and the AC high voltage is supplied to the two pairs of CCFLs 120. Second end portions of the two pairs of the CCFL 120 connected to the two pairs of the secondary coils 2112, 2113, 2114 and 2115 are connected to the ground GND.

A primary coil 2121 of the balance transformer 212 is serially connected to the secondary coils 2112 and 2113 of the inverter transformer 211. A primary coil 2131 of the balance transformer 213 is serially connected to the secondary coils 2114 and 2115 of the inverter transformer 211.

Secondary coils 1132, 1142, 2122 and 2132 of the four balance transformers 113, 114, 212 and 213 are serially connected to each other to form a loop. A portion of the loop formed by the secondary coils 1132, 1142, 2122 and 2132 of the four balance transformers 113, 114, 212 and 213 is connected to the ground GND.

A primary coil 1151 of the current detection transformer 115 is serially connected to the secondary coils 1132, 1142, 2122 and 2132 of the four balance transformers 113,114, 212 and 213. A secondary coil 1152 of the current detection transformer 115 is connected between the inverter 111 and the ground GND. In the secondary coil 1152 of the current detection transformer 115, a value of current induced by the primary coil 1151 of the current detection transformer 115 is transformed into a current detection value which is provided to the inverter 111.

According to the second exemplary embodiment of the present invention, current flowing through the four pairs of the CCFLs 120 is uniformly maintained by an operation of the four balance transformers 113, 114, 212 and 213 since the primary coils 1131, 1141, 2121 and 2131 of the balance transformers are serially connected to the secondary coils 1122, 1123, 1124, 1125, 2112, 2113, 2114 and 2115 of the inverter transformers, the secondary coils 1132, 1142, 2122 and 2132 of the balance transformers 113, 114, 212 and 213, respectively, are serially connected to each other to form a loop, and the four balance transformers 113, 114, 212 and 213 and the portion of the loop which is connected to the ground GND are employed.

In addition, according to the second exemplary embodiment of the present invention, the four balance transformers 113, 114, 212 and 213 are employed so as to compensate for a shortage of a starting voltage, such that the CCFL 120 is maintained in a turned on state, even if the starting voltage is temporarily insufficient in a portion of the four pairs of the CCFLs 120.

In addition, according to the second exemplary embodiment of the present invention, since four balance transformers 113, 114, 212 and 213 are employed, the two inverter transformers 112 and 211 connected to each other in parallel may be realized as one inverter.

Further, according to the second exemplary embodiment of the present invention, since current detection interconnections are unnecessary for the secondary coils of the inverter transformer, designs of the secondary coils of the inverter transformer may be similar to each other.

Figure 4:
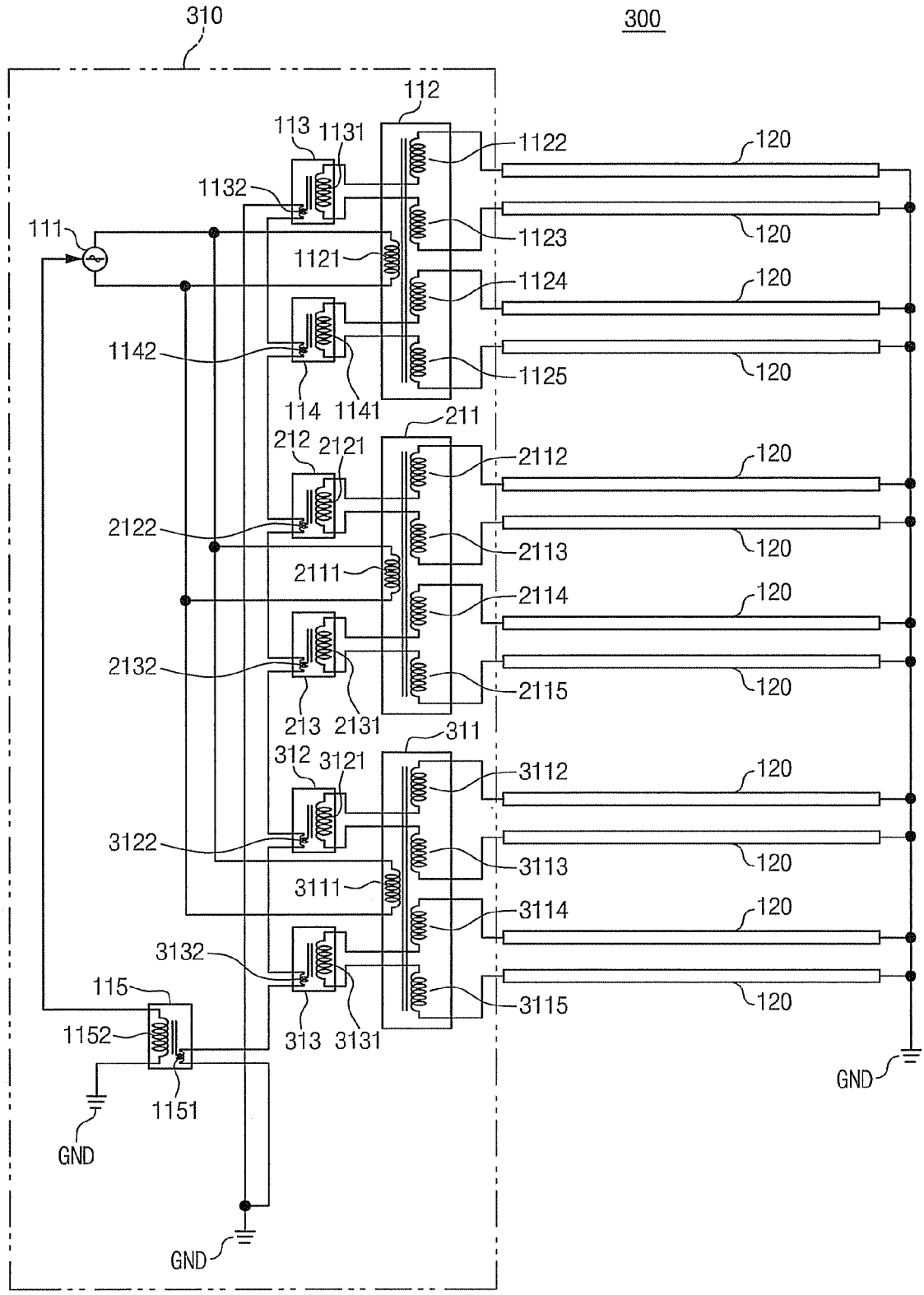
FIG. 4 is a circuit schematic diagram illustrating an exemplary inverter circuit and an exemplary backlight assembly according to a third embodiment of the present invention.

Hereinafter, a third exemplary embodiment of the present invention will be described in detail with reference to accompanying drawings. FIG. 4 is a circuit diagram illustrating an exemplary inverter circuit 310 and an exemplary backlight assembly 300 according to the third exemplary embodiment of the present invention. The same reference numerals will be assigned to the elements identical to the elements shown in the second exemplary embodiment, and detailed description thereof will be omitted in order to avoid redundancy.

Referring to FIG. 4, the backlight assembly 300 includes the inverter circuit 310 and six pairs of CCFLs (discharge tubes) 120.

The inverter circuit 310 includes one inverter 111, three inverter transformers 112, 211 and 311, six balance transformers 113, 114, 212, 213, 312 and 313, and a current detection transformer 115.

The inverter transformer 311 includes one primary coil 3111 connected to an output terminal of the inverter 111. The inverter transformer 311 and the inverter transformers 112 and 211 are connected to the inverter 111 in parallel with each other. In addition, the inverter transformer 311 includes two pairs of secondary coils 3112, 3113, 3114 and 3115 connected to first end portions of two pairs of the CCFLs 120. In the two pairs of the secondary coils 3112, 3113, 3114 and 3115 of the inverter transformer 311, an AC high voltage is induced by the primary coil 3111, and the AC high voltage is supplied to the two pairs of CCFLs 120. Second end portions of the two pairs of the CCFL 120 connected to the two pairs of the secondary coils 3112, 3113, 3114 and 3115 are connected to the ground GND.

A primary coil 3121 of the balance transformer 312 is serially connected to the secondary coils 3112 and 3113 of the inverter transformer 311. A primary coil 3131 of the balance transformer 313 is serially connected to the secondary coils 3114 and 3115 of the inverter transformer 311.

Secondary coils 1132, 1142, 2122, 2132, 3122 and 3132 of six balance transformers 113, 114, 212, 213, 312 and 313 are serially connected to each other to form a loop. A portion of the loop formed by the secondary coils 1132, 1142, 2122, 2132, 3122 and 3132 of the six balance transformers 113, 114, 212, 213, 312 and 313 is connected to the ground GND.

A primary coil 1151 of the current detection transformer 115 is serially connected to the secondary coils 1132, 1142, 2122, 2132, 3122 and 3132 of the six balance transformers 113, 114, 212, 213, 312 and 313. A secondary coil 1152 of the current detection transformer 115 is connected between the inverter 111 and the ground GND. In the secondary coil 1152 of the current detection transformer 115, a value of current induced by the first primary coil 1151 of the current detection transformer 115 is transformed into a current detection value which is provided to the inverter 111.

According to the third exemplary embodiment of the present invention, current flowing through the six pairs of the CCFLs 120 is uniformly maintained by an operation of the six balance transformers 113, 114, 212, 213, 312 and 313 since the primary coils 1131, 1141, 2121, 2131, 3121 and 3131 of the balance transformers 113, 114, 212, 213, 312 and 313 are serially connected to the secondary coils 1122, 1123, 1124, 1125, 2112, 2113, 2114, 2115, 3112, 3113, 3114 and 3115 of the inverter transformers 112, 211 and 311, the secondary coils 1132, 1142, 2122, 2132, 3122 and 3132 of the balance transformers 113, 114, 212, 213, 312 and 313 are serially connected to each other to form a loop, and the six balance transformers 113, 114, 212, 213, 312 and 313 and the portion of the loop which is connected to the ground GND are employed. In addition, according to the third exemplary embodiment of the present invention, six balance transformers 113, 114, 212, 213, 312 and 313 are employed so as to compensate for a shortage of a starting voltage such that the CCFL 120 is maintained in a turned on state, even if the starting voltage is temporarily insufficient in a portion of the six pairs of the CCFLs 120.

Further, according to the third exemplary embodiment of the present invention, since the six balance transformers 113, 114, 212, 213, 312 and 313 are employed, the three inverter transformers 112, 211 and 311, which are connected to each other in parallel, may be operated as one inverter.

In addition, according to the third exemplary embodiment of the present invention, since current detection interconnections are unnecessary for the secondary coils of the inverter transformer, designs of the secondary coils of the inverter transformer can be similar to each other.

Figure 5:
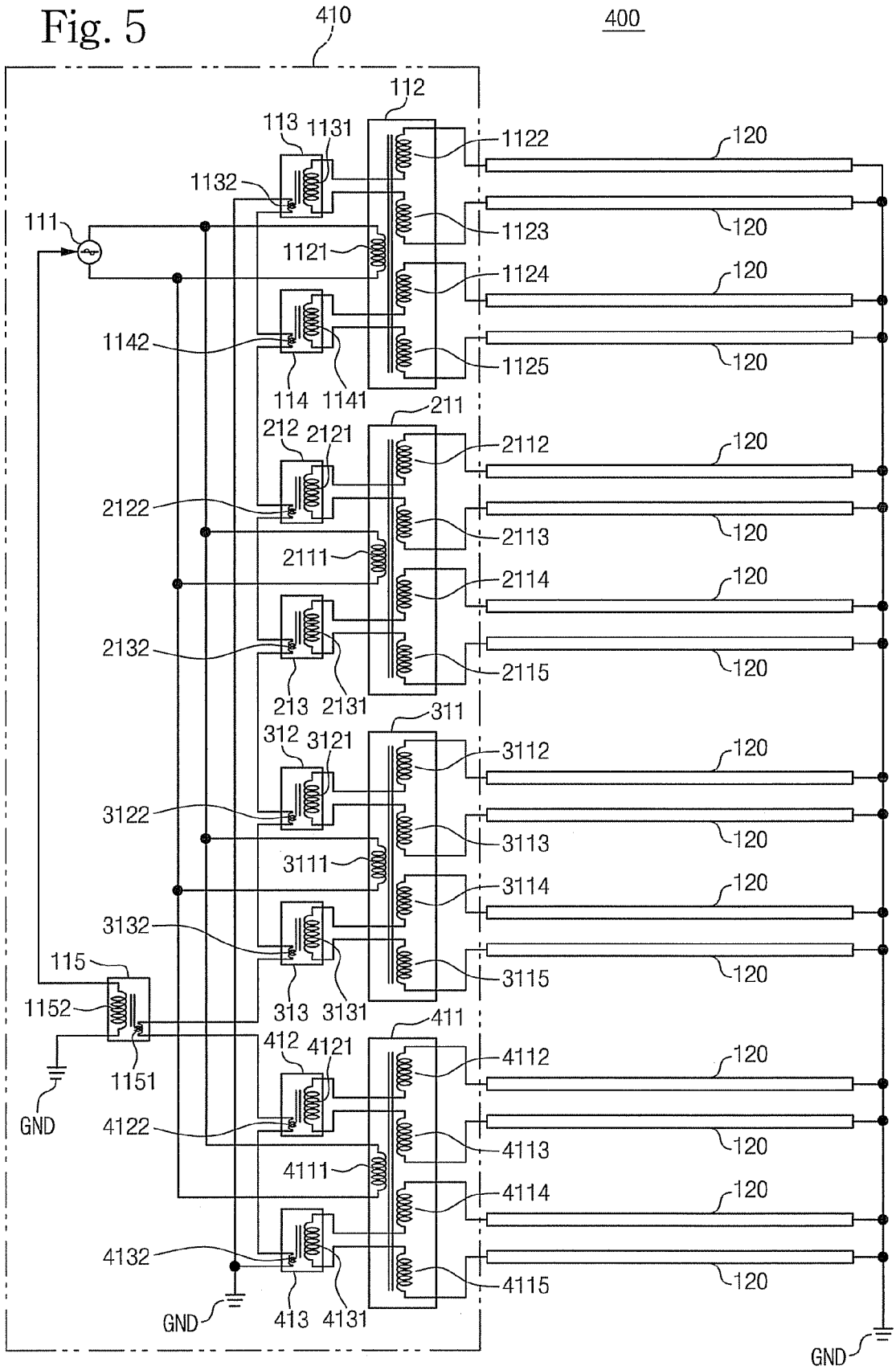
FIG. 5 is a circuit schematic diagram illustrating an exemplary inverter circuit and an exemplary backlight assembly according to a fourth embodiment of the present invention.

Hereinafter, the fourth exemplary embodiment of the present invention will be described in detail with reference to accompanying drawings. FIG. 5 is a circuit schematic diagram illustrating an exemplary inverter circuit 410 and an exemplary backlight 400 assembly according to the fourth exemplary embodiment. The same reference numerals will be assigned to the elements identical to the elements shown in the third exemplary embodiment, and detailed description thereof will be omitted in order to avoid redundancy.

Referring to FIG. 5, the backlight assembly 400 includes the inverter circuit 410 and eight pairs of CCFLs (discharge tubes) 120.

The inverter circuit 410 includes one inverter 111, four inverter transformers 112, 211, 311 and 411, eight balance transformers 113, 114, 212, 213, 312, 313, 412 and 413, and a current detection transformer 115.

The inverter transformer 411 includes one primary coil 4111 connected to an output terminal of the inverter 111. The inverter transformer 411 and the inverter transformers 112, 211 and 311 are connected to the inverter 111 in parallel with each other. In addition, the inverter transformer 411 includes two pairs of secondary coils 4112, 4113, 4114 and 4115 connected to first end portions of two pairs of the CCFLs 120. In the two pairs of the secondary coils 4112, 4113, 4114 and 4115 of the inverter transformer 411, an AC high voltage is induced by the primary coil 4111, and the AC high voltage is supplied to the two pairs of CCFLs 120. Second end portions of the two pairs of the CCFL 120 connected to the two pairs of the secondary coils 4112, 4113, 4114 and 4115 are connected to the ground GND.

A primary coil 4121 of the balance transformer 412 is serially connected to the secondary coils 4112 and 4113 of the inverter transformer 411. A primary coil 4131 of the balance transformer 413 is serially connected to the secondary coils 4114 and 4115 of the inverter transformer 411.

Secondary coils 1132, 1142, 2122, 2132, 3122, 3132, 4122 and 4132 of the eight balance transformers 113, 114, 212, 213, 312, 313, 412 and 413 are serially connected to each other to form a loop. A portion of the loop formed by the secondary coils 1132, 1142, 2122, 2132, 3122, 3132, 4122 and 4132 of the eight balance transformers 113, 114, 212, 213, 312, 313, 412 and 413 is connected to the ground GND.

A primary coil 1151 of the current detection transformer 115 is serially connected to the secondary coils 1132, 1142, 2122, 2132, 3122, 3132, 4122 and 4132 of the eight balance transformers 113, 114, 212, 213, 312, 313, 412 and 413. A secondary coil 1152 of the current detection transformer 115 is connected between the inverter 111 and the ground GND. In the secondary coil 1152 of the current detection transformer 115, a value of current induced by the first primary 1151 of the current detection transformer 115 is transformed into a current detection value which is provided to the inverter 111.

According to the fourth exemplary embodiment of the present invention, current flowing through the eight pairs of the CCFLs 120 is uniformly maintained by the operation of the eight balance transformers 113, 114, 212, 213, 312, 313, 412 and 413 since the primary coils 1131, 1141, 2121, 2131, 3121, 3131, 4121 and 4131 of the balance transformers 113, 114, 212, 213, 312, 313, 412 and 413 are serially connected to the secondary coils 1122, 1123, 1124, 1125, 2112, 2113, 2114, 2115, 3112, 3113, 3114, 3115, 4112, 4113, 4114 and 4115 of the inverter transformers 112, 211, 311 and 411, the secondary coils 1132, 1142, 2122, 2132, 3122, 3132, 4122 and 4132 of the balance transformers 113, 114, 212, 213, 312, 313, 412 and 413 are serially connected to each other to form a loop, and the eight balance transformers 113, 114, 212, 213, 312, 313, 412 and 413 and the portion of the loop which is connected to the ground GND are employed.

In addition, according to the fourth exemplary embodiment of the present invention, since eight balance transformers 113, 114, 212, 213, 312, 313, 412 and 413 are employed, the eight balance transformers 113, 114, 212, 213, 312, 313, 412 and 413 compensate for a shortage of a starting voltage such that the CCFL 120 is maintained in a turned on state even if the starting voltage is temporarily insufficient in a portion of the eight pairs of the CCFLs 120.

Further, according to the fourth exemplary embodiment of the present invention, since the eight balance transformers 113, 114, 212, 213, 312, 313, 412 and 413 are employed, the four inverter transformers 112, 211, 311, and 411, which are connected to each other in parallel, may be operated as one inverter.

In addition, according to the fourth exemplary embodiment of the present invention, since current detection interconnections are unnecessary for the secondary coils of the inverter transformer, designs of the secondary coils of the inverter transformer may be substantially similar to each other.

Figure 6:
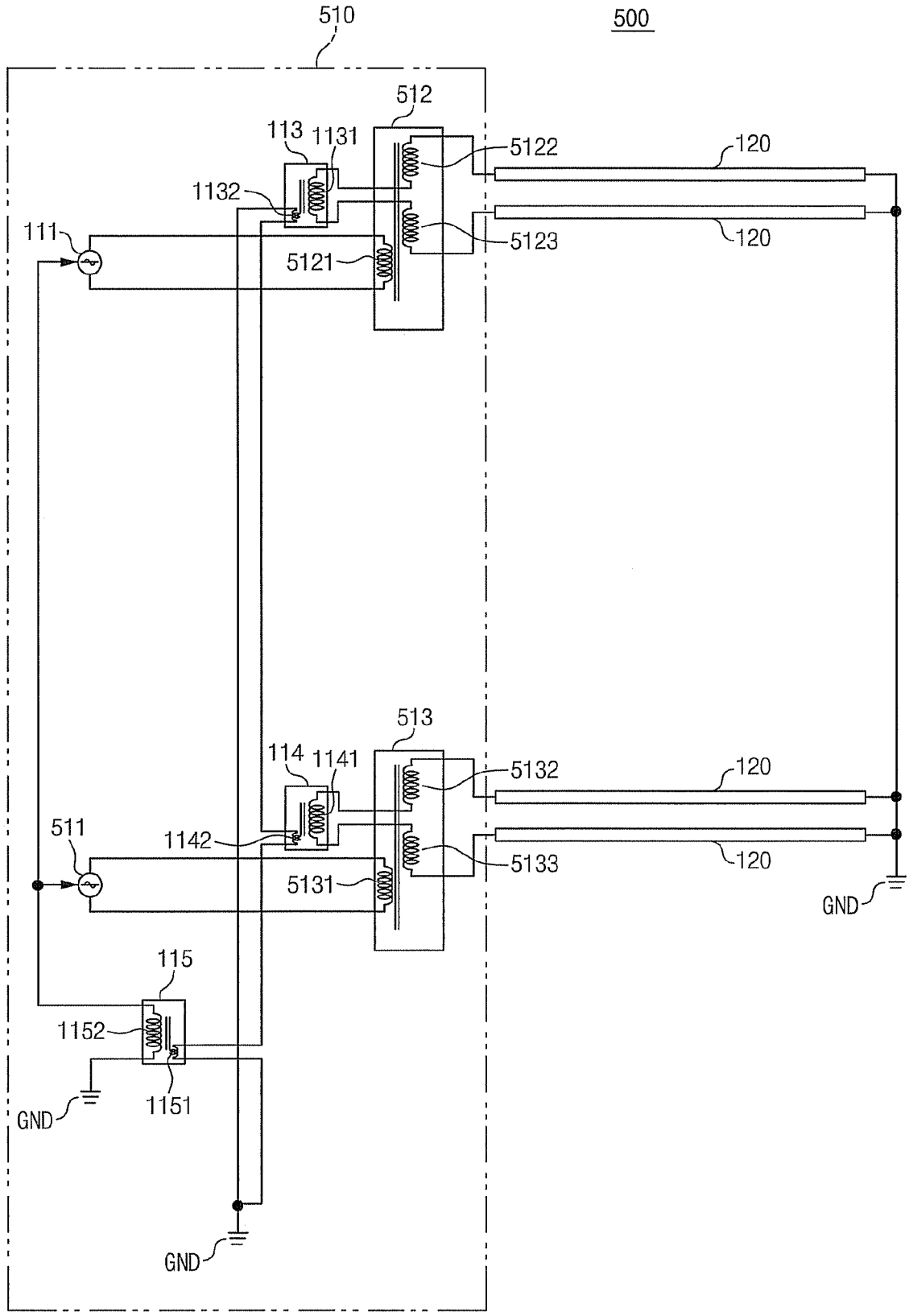
FIG. 6 is a circuit schematic diagram illustrating an exemplary inverter circuit and an exemplary backlight assembly according to a fifth embodiment of the present invention.

Hereinafter, a fifth exemplary embodiment of the present invention will be described in detail with reference to accompanying drawings. FIG. 6 is a circuit schematic diagram illustrating an exemplary inverter circuit 510 and an exemplary backlight assembly 500 according to the fifth exemplary embodiment of the present invention. The same reference numerals will be assigned to the elements identical to the elements shown in the first exemplary exemplary embodiment, and detailed description thereof will be omitted in order to avoid redundancy.

Referring to FIG. 6, the backlight assembly 500 includes an inverter circuit 510 and two pairs of CCFLs (discharge tubes) 120.

The inverter circuit 510 includes two inverters 111 and 511, two inverter transformers 512 and 513, two balance transformers 113 and 114 and a current detection transformer 115.

The inverter 111 controls an output signal based on a current detection value fedback from the current detection transformer 115. The inverter transformer 512 includes one primary coil 5121 connected to an output terminal of the inverter 111. In addition, the inverter transformer 512 includes one pair of secondary coils 5122 and 5123 connected to first end portions of one pair of the CCFLs 120. In the one pair of the secondary coils 5122 and 5123 of the inverter transformer 512, an AC high voltage is induced by the primary coil 5121, and the AC high voltage is supplied to the one pair of the CCFLs 120. Second end portions of the one pair of the CCFLs 120 are connected to the ground GND.

The inverter 511 includes the same structure as that of the inverter 111. The inverter 511 controls an output signal based on a current detection value fedback from the current detection transformer 115. The inverter transformer 513 includes one primary coil 5131 connected to an output terminal of the inverter 511. In addition, the inverter transformer 513 includes one pair of secondary coils 5132 and 5133 connected to first end portions of one pair of CCFLs 120. In the one pair of the secondary coils 5132 and 5133 of the inverter transformer 513, an AC high voltage is induced by the primary coil 5131, and the AC high voltage is supplied to the one pair of the CCFLs 120. Second end portions of the one pair of the CCFL 120 are connected to the ground GND.

A primary coil 1131 of the balance transformer 113 is serially connected to the secondary coils 5122 and 5123 of the inverter transformer 512. A primary coil 1141 of the balance transformer 114 is serially connected to the secondary coils 5132 and 5133 of the inverter transformer 513.

Secondary coils 1132 and 1142 of the two balance transformers 113 and 114 are serially connected to each other to form a loop. A portion of the loop formed by the secondary coils 1132 and 1142 of the two balance transformers 113 and 114 is connected to the ground GND.

A primary coil 1151 of the current detection transformer 115 is serially connected to the secondary coils 1132 and 1142 of the two balance transformers 113 and 114. A secondary coil 1152 of the current detection transformer 115 is connected between the inverters 111 and 511 and the ground GND. In the secondary coil 1152 of the current detection transformer 115, a value of current induced by the first primary 1151 of the current detection transformer 115 is transformed into a current detection value which is provided to the inverters 111 and 511. The inverter 511 performs substantially the same operation as that of the inverter 111.

In other words, the inverter 511 controls an AC voltage of an output signal based on the current detection value fedback from the current detection transformer 115 so as to supply a proper AC voltage to the primary coil 5131 of the inverter transformer 513.

According to the fifth exemplary embodiment of the present invention, current flowing through two pairs of the CCFLs 120 is uniformly maintained by an operation of the two balance transformers 113 and 114 since the primary coils 1131 and 1141 of the balance transformers 113 and 114 are serially connected to the secondary coils 5122, 5123, 5132 and 5133 of the inverter transformers 512 and 513, the secondary coils 1132 and 1142 of the balance transformers are serially connected to each other to form a loop, and the two balance transformers 113 and 114 and the portion of the loop which is connected to the ground GND are employed.

In addition, according to the fifth exemplary embodiment of the present invention, since the two balance transformers 113 and 114 are employed, the two balance transformers 113 and 114 compensate for a shortage of a starting voltage such that a CCFL 120 is maintained in a turned on state even if the starting voltage is temporarily insufficient in a portion of two pairs of the CCFLs 120.

In addition, according to the fifth exemplary embodiment of the present invention, since current detection interconnections are unnecessary for the secondary coils of the inverter transformer, designs of the secondary coils of the inverter transformer can be similar to each other.

Figure 7:
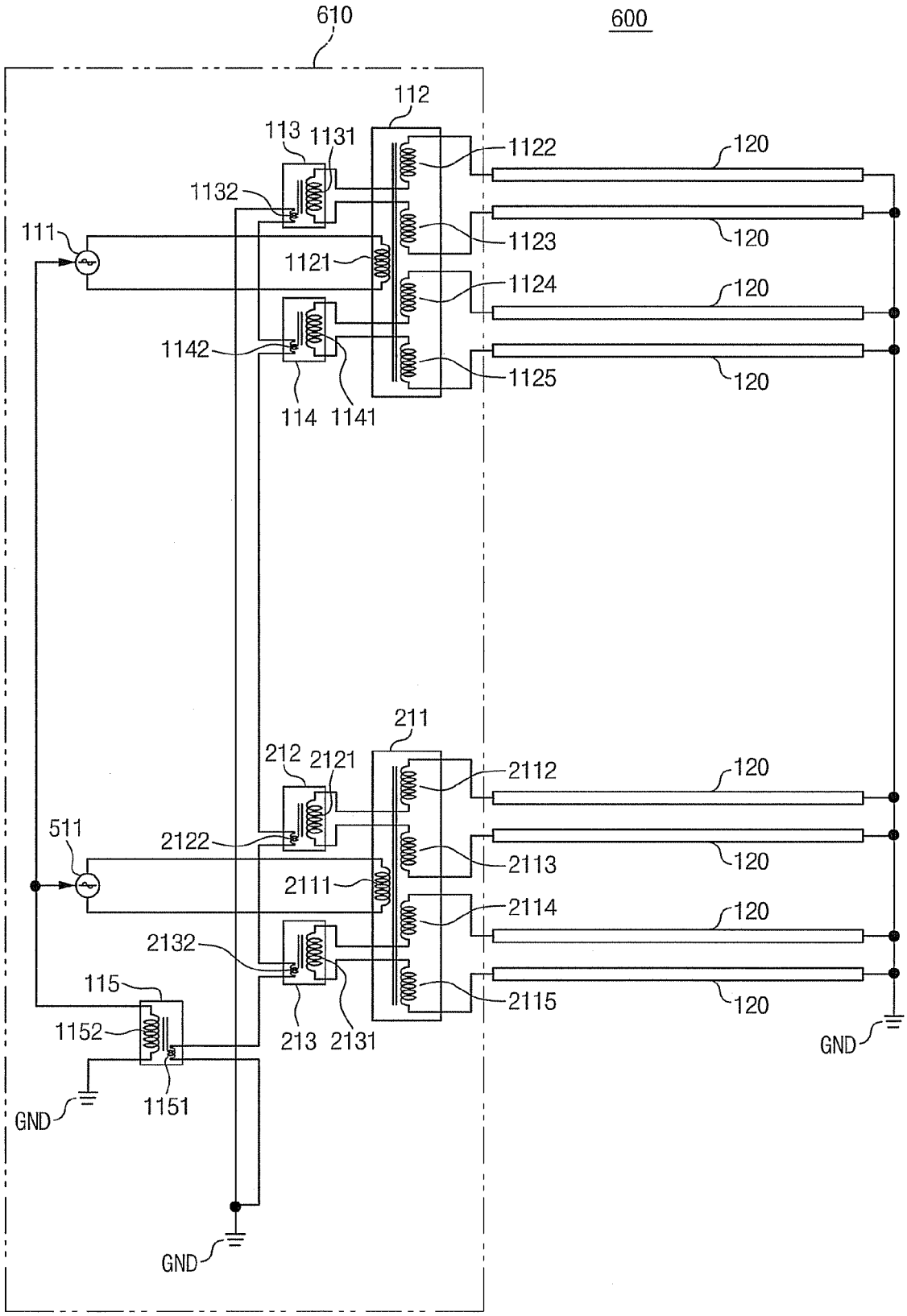
FIG. 7 is a circuit schematic diagram illustrating an exemplary inverter circuit and an exemplary backlight assembly according to a sixth embodiment of the present invention.

Hereinafter, a sixth exemplary embodiment of the present invention will be described in detail with reference to the accompanying drawings. FIG. 7 is a schematic circuit diagram illustrating an exemplary inverter circuit 610 and an exemplary backlight assembly 600 according to the sixth exemplary embodiment of the present invention. The same reference numerals will be assigned to the elements identical to the elements shown in the second and fifth exemplary embodiments, and detailed description thereof will be omitted in order to avoid redundancy.

Referring to FIG. 7, the backlight assembly 600 includes the inverter circuit 610 and four pairs of a CCFL (discharge tube) 120.

The inverter circuit 610 includes two inverters 111 and 511, two inverter transformers 112 and 211, four balance transformers 113, 114, 212 and 213, and a current detection transformer 115.

The inverter transformer 112 includes one primary coil 1121 connected to an output terminal of the inverter 111. The inverter transformer 112 includes two pairs of secondary coils 1122, 1123, 1124 and 1125 connected to first end portions of two pairs of the cathode ray tubes 120. The two pairs of the secondary coils 1122, 1123, 1124 and 1125 of the inverter transformer 112 provide an AC high voltage, which is induced by the primary coil 1121, to the two pairs of the CCFLs 120. Second end portions of the two pairs of the CCFLs 120 connected to the two pairs of the secondary coils 1122, 1123, 1124 and 1125 are connected to the ground GND.

The inverter transformer 211 includes one primary coil 2111 connected to an output terminal of the inverter 511. The inverter transformer 211 includes two pairs of secondary coils 2112, 2113, 2114 and 2115 connected to first end portions of two pairs of the CCFLs 120. The two pairs of the secondary coils 2112, 2113, 2114 and 2115 of the inverter transformer 211 provide an AC high voltage, which is induced by the primary coil 2111, to the two pairs of the CCFLs 120. Second end portions of the two pairs of the cathode ray tubes 120 connected to the two pairs of the secondary coils 2112, 2113, 2114 and 2115 are connected to the ground GND.

A primary coil 1131 of the balance transformer 113 is serially connected to the secondary coils 1122 and 1123 of the inverter transformer 112, and a primary coil 1141 of the balance transformer 114 is serially connected to the secondary coils 1124 and 1125 of the inverter transformer 112.

A primary coil 2121 of the balance transformer 212 is serially connected to the secondary coils 2112 and 2113 of the inverter transformer 211, and a primary coil 2131 of the balance transformer 213 is serially connected to the secondary coils 2114 and 2115 of the inverter transformer 211.

Secondary coils 1132, 1142, 2122 and 2132 of the four balance transformers 113, 114, 212 and 213 are serially connected to each other to form a loop. A portion of the loop formed by the secondary coils 1132, 1142, 2122 and 2132 of the four balance transformer 113, 114, 212 and 213 is connected to the ground GND.

A primary coil 1151 of the current detection transformer 115 is serially connected to the secondary coils 1132, 1142, 2122 and 2132 of the four balance transformers 113, 114, 212 and 213. A secondary coil 1152 of the current detection transformer 115 is connected between the inverters 111 and 511 and the ground GND. In the secondary coil 1152 of the current detection transformer 115, a value of current induced by the first primary 1151 of the current detection transformer 115 is transformed into a current detection value which is provided to the inverters 111 and 511.

According to the sixth exemplary embodiment of the present invention, current flowing through four pairs of the CCFLs 120 is uniformly maintained by an operation of the four balance transformers 113, 114, 212 and 213 since the primary coils 1131, 1141, 2121 and 2131 of the balance transformers 113, 114, 212 and 213 are serially connected to the secondary coils 1122, 1123, 1124, 1125, 2112, 2113, 2114 and 2115 of the inverter transformers 112 an 211, the secondary coils 1132, 1142, 2122 and 2132 of the balance transformers are serially connected to each other to form a loop, and the four balance transforms 113, 114, 212 and 213 and the portion of the loop which is connected to the ground GND are employed.

In addition, according to the sixth exemplary embodiment of the present invention, the four balance transformers 113, 114, 212 and 213 are employed so as to compensate for a shortage of a starting voltage, such that a CCFL 120 is maintained in a turned on state even if the starting voltage is temporarily insufficient in a portion of two pairs of the CCFLs 120.

In addition, according to the sixth exemplary embodiment of the present invention, since current detection interconnections are unnecessary for the secondary coils of the inverter transformer, details of the secondary coils of the inverter transformer can be similar to each other.

Figure 8:
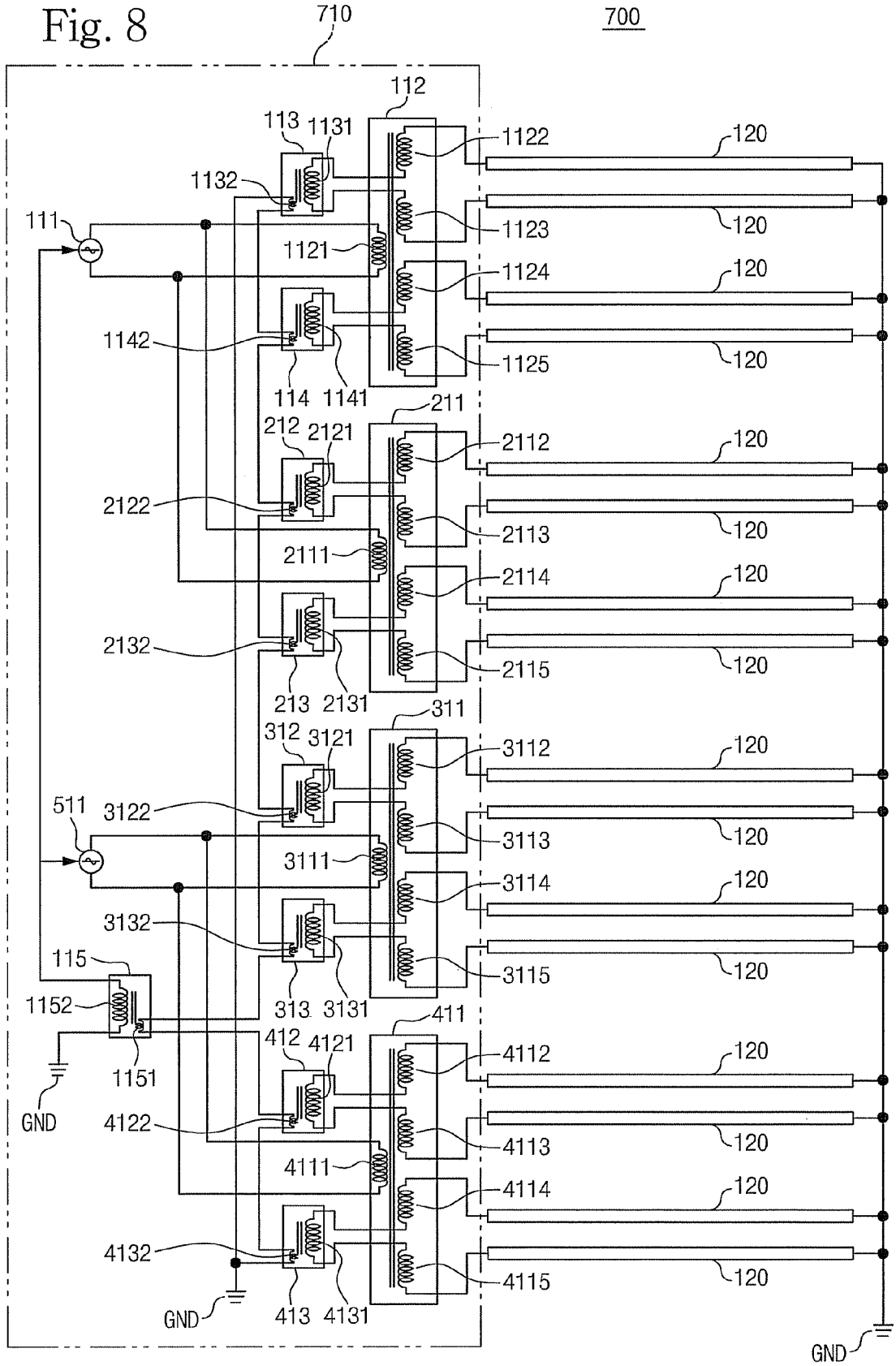
FIG. 8 is a circuit schematic diagram illustrating an exemplary inverter circuit and an exemplary backlight assembly according to a seventh embodiment of the present invention.

Hereinafter, a seventh exemplary embodiment of the present invention will be described in detail with reference to the accompanying drawings. FIG. 8 is a schematic circuit diagram illustrating an exemplary inverter circuit 710 and an exemplary backlight assembly 700 according to the seventh exemplary embodiment of the present invention. The same reference numerals will be assigned to the elements identical to the elements shown in the fourth and sixth exemplary embodiments, and detailed description thereof will be omitted in order to avoid redundancy.

Referring to FIG. 8, the backlight assembly 700 includes the inverter circuit 710 and eight pairs of CCFLs (discharge tubes) 120.

The inverter circuit 710 includes two inverters 111 and 511, four inverter transformers 112, 211, 311 and 411, eight balance transformers 113, 114, 212, 213, 312, 313, 412 and 413, and a current detection transformer 115.

According to the seventh exemplary embodiment of the present invention, the two inverters 111 and 511, two inverter transformers 112 and 211 connected to an output terminal of the inverter 111 in parallel and two inverter transformers 311 and 411 connected to the inverter 511 in parallel may be provided. The structure of the backlight assembly 700 according to the seventh exemplary embodiment is substantially the same as that of the fourth exemplary embodiment, except for the above mentioned elements.

The inverter 511 controls an AC voltage of an output signal based on a detected current fedback from the current detection transformer 115 so as to supply a proper AC voltage to the primary coils 3111 and 4111 of the inverter transformers 311 and 411. An operation of the backlight assembly 700 according to the seventh exemplary embodiment of the present invention is substantially similar to that of the fourth exemplary embodiment, except for the above mentioned operation of the inverter 511.

According to the seventh exemplary embodiment of the present invention, current flowing through eight pairs of the CCFLs 120 is uniformly maintained by an operation of the eight balance transformers 113, 114, 212, 213, 312, 313, 412 and 413 since the primary coils of the balance transformers are serially connected to the secondary coils of the inverter transformers, the secondary coils of the balance transformers are serially connected to each other while forming a loop, and the eight balance transforms 113, 114, 212, 213, 312, 313, 412 and 413 and the portion of the loop which is connected to the ground GND are employed.

In addition, according to the seventh exemplary embodiment of the present invention, the eight balance transformers 113, 114, 212, 213, 312, 313 412, and 413 are employed so as to compensate for a shortage of a starting voltage, such that a CCFL 120 is maintained in a turned on state even if the starting voltage is temporarily insufficient in a portion of the eight pairs of the CCFLs 120.

In addition, according to the seventh exemplary embodiment of the present invention, since current detection interconnections are unnecessary for the secondary coils of the inverter transformer, designs of the secondary coils of the inverter transformer can be similar to each other.

In exemplary embodiments of the present invention, the two inverters 111 and 511, three or four inverter transformers connected to the output terminal of the inverter 111 in parallel (see, FIGS. 4 and 5), and three or four inverter transformers connected to the output terminals of the inverter 511 (see, FIGS. 4 and 5) may be provided. In addition, the structure according to another exemplary embodiment may be substantially the same as those of FIGS. 4 and 5, except for the above described elements.

Figure 9:
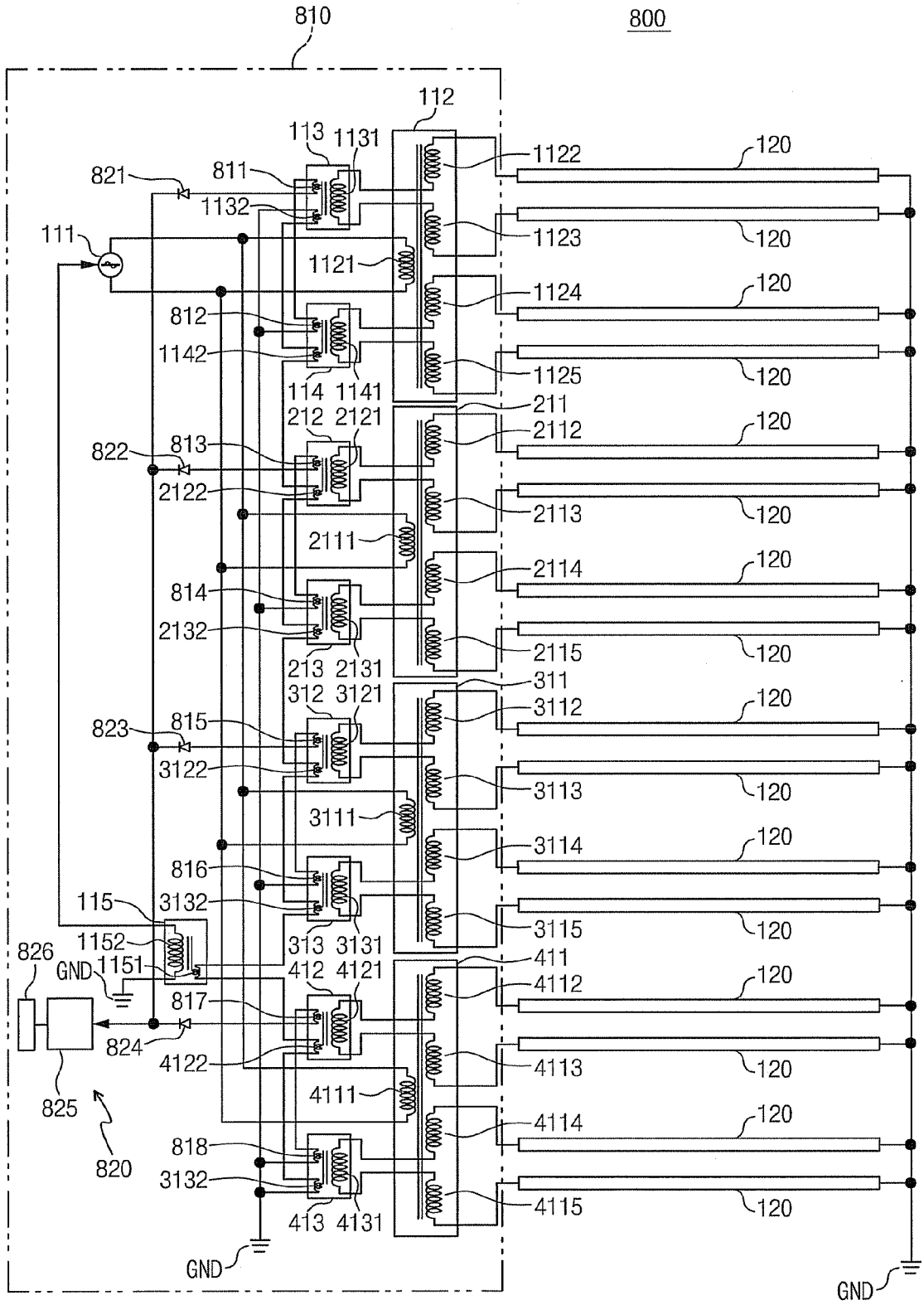
FIG. 9 is a circuit schematic diagram illustrating an exemplary inverter circuit and an exemplary backlight assembly according to an eighth embodiment of the present invention.

Hereinafter, an eighth exemplary embodiment of the present invention will be described in detail with reference to accompanying drawings. FIG. 9 is a schematic circuit diagram illustrating an exemplary inverter circuit 810 and an exemplary backlight assembly 800 according to the eighth exemplary embodiment of the present invention. The same reference numerals will be assigned to the elements identical to the elements shown in the fourth exemplary embodiment, and detailed description thereof will be omitted in order to avoid redundancy.

Referring to FIG. 9, the backlight assembly 800 includes the inverter circuit 810 and eight pairs of CCFLs (discharge tubes) 120.

The inverter circuit 810 includes one inverter 111, four inverter transformers 112, 211, 311 and 411, eight balance transformers 113, 114, 212, 213, 312, 313, 412 and 413, a current detection transformer 115 and a fault detection assembly 820. In other words, the inverter circuit 810 includes the fault detection assembly 820 in addition to the inverter circuit 410 according to the fourth exemplary embodiment of the present invention.

The fault detection assembly 820 detects a high voltage discharge such as a corona discharge and an arc discharge occurring due to a defect of an insulating material between a high voltage unit and the ground GND in the inverter circuit 110.

The fault detection assembly 820 detects the fault of the insulating material referring to current flowing through a plurality of balance transformers 113, 114, 212, 213, 312, 313, 412 and 413.

The fault detection assembly 820 includes a plurality of tertiary coils 811, 812, 813, 814, 815, 816, 817 and 818 positioned in the balance transformers 113, 114, 212, 213, 312, 313, 412 and 413, and diodes 821, 822, 823 and 824, a fault detector 825 and a notification unit 826.

In order to offset AC voltages generated from neighboring tertiary coils from each other, a pair of neighboring tertiary coils among the plurality of tertiary coils is serially connected to each other, and one end portion of the connection body of the pair of neighboring tertiary coils is linked with the loop formed by the secondary coils.

In other words, a pair of the neighboring tertiary coils 811 and 812 is serially connected to each other such that AC voltages generated from the neighboring tertiary coils 811 and 812 are offset from each other, and one end portion of the connection body of the neighboring tertiary coils 811 and 812 is linked with the loop formed by the secondary coils 1132, 1142, 2122, 2132, 3122, 3132, 4122 and 4132.

Further, a pair of the neighboring tertiary coils 813 and 814 is serially connected to each other such that AC voltages generated from the neighboring tertiary coils 813 and 814 are offset from each other, and one end portion of the connection body of the neighboring tertiary coils 813 and 814 is linked with the loop formed by the secondary coils 1132, 1142, 2122, 2132, 3122, 3132, 4122 and 4132.

In addition, a pair of the neighboring tertiary coils 815 and 816 is serially connected to each other such that AC voltages generated from the neighboring tertiary coils 815 and 816 are offset from each other, and one end portion of the connection body of the neighboring tertiary coils 815 and 816 is linked with the loop formed by the secondary coils 1132, 1142, 2122, 2132, 3122, 3132, 4122 and 4132.

In addition, a pair of the neighboring tertiary coils 817 and 818 is serially connected to each other such that AC voltages generated from the neighboring tertiary coils 817 and 818 are offset from each other, and one end portion of the connection body of the neighboring tertiary coils 817 and 818 is linked with the loop formed by the secondary coils 1132, 1142, 2122, 2132, 3122, 3132, 4122 and 4132.

The diodes 821, 822, 823 and 824 include input terminals connected to one end portion of the connection body of the paired neighboring tertiary coils, and detect current flowing through the connection body in order to create a current detection value.

In other words, the diode 821 includes an input terminal connected to one end portion of the connection body of the neighboring tertiary coils 811 and 812, and detects a current flowing through the connection body in order to create a current detection value.

In addition, the diode 822 includes an input terminal connected to one end portion of the connection body of the paired neighboring tertiary coils 813 and 814, and detects a current flowing through the connection body in order to create a current detection value.

In addition, the diode 823 includes an input terminal connected to one end portion of the connection body of the paired neighboring tertiary coils 815 and 816, and detects a current flowing through the connection body in order to create a current detection value.

In addition, the diode 824 includes an input terminal connected to one end portion of the connection body of the paired neighboring tertiary coils 817 and 818, and detects a current flowing through the connection body in order to create a current detection value.

The fault detector 825 is connected to output terminals of the diodes 821, 822, 823 and 824 in order to compare the current detection value through the diodes 821, 822, 823, or 824 or a voltage detection value, into which the current detection value is converted, with a predetermined reference value. Then, the fault detector 825 determines a fault state to create the determination result.

Figure 10:
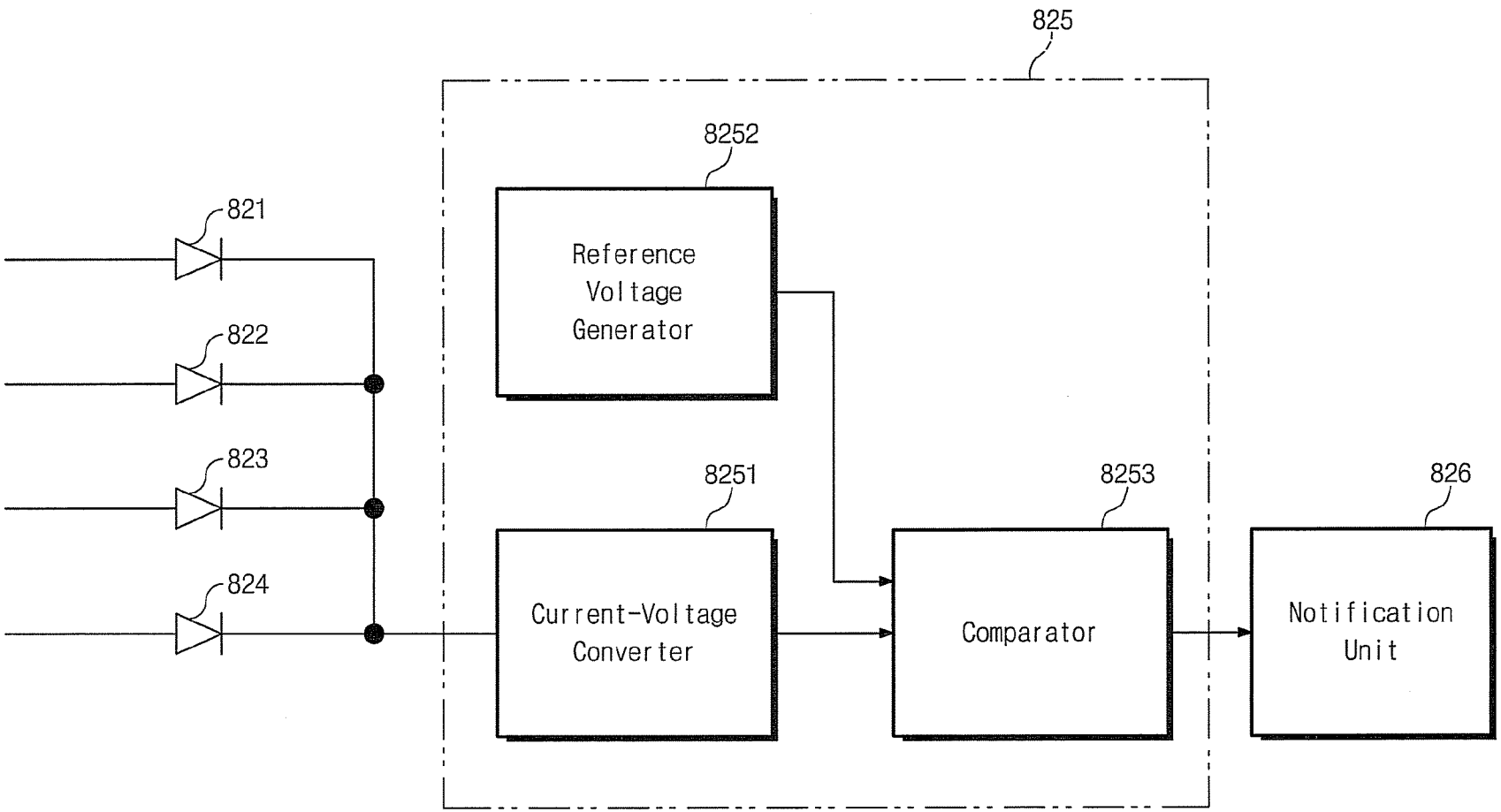
FIG. 10 is a block diagram illustrating a structure of an exemplary fault detector according to the eighth embodiment of the present invention.

As an example, the fault detector 825 will be described below with reference to FIG. 10. FIG. 10 is a block diagram illustrating a structure of the fault detector 825 according to one exemplary embodiment of the present invention.

Referring to FIG. 10, the fault detector 825 includes a current-voltage converter 8251, a reference voltage generator 8252 and a comparator 8253.

An input terminal of the current-voltage converter 8251 is connected to the output terminals of the diodes 821, 822, 823 and 824. An output terminal of the current-voltage converter 8251 is connected to a first input terminal of the comparator 8253. An output terminal of the reference voltage generator 8252 is connected to a second input terminal of the comparator 8253. An output terminal of the comparator 8253 is connected to an input terminal of the notification unit 826.

The current-voltage converter 8251 converts a current detection value output from the diode 821, 822, 823 and 824 into a voltage detection value to provide the voltage detection value to the comparator 8253. The reference voltage generator 8252 generates reference voltage to supply the reference voltage to the comparator 8253. The comparator 8253 compares the voltage detection value from the current-voltage converter 8251 with the value of the reference voltage of the reference voltage generator 8252 to provide a comparison result to the notification unit 826. The notification unit 826 notifies the comparison result output from the comparator 8253. For example, the notification unit 826 displays the comparison result on a display (not shown).

In addition, according to the eighth exemplary embodiment of the present invention, the fault detection assembly 820 may detect and notify a fault in addition to other effects of the exemplary embodiments.

Further, the fault detection assembly 820 may be added to the structure of the other exemplary embodiments with exception to the fourth exemplary embodiment.

Figure 11:
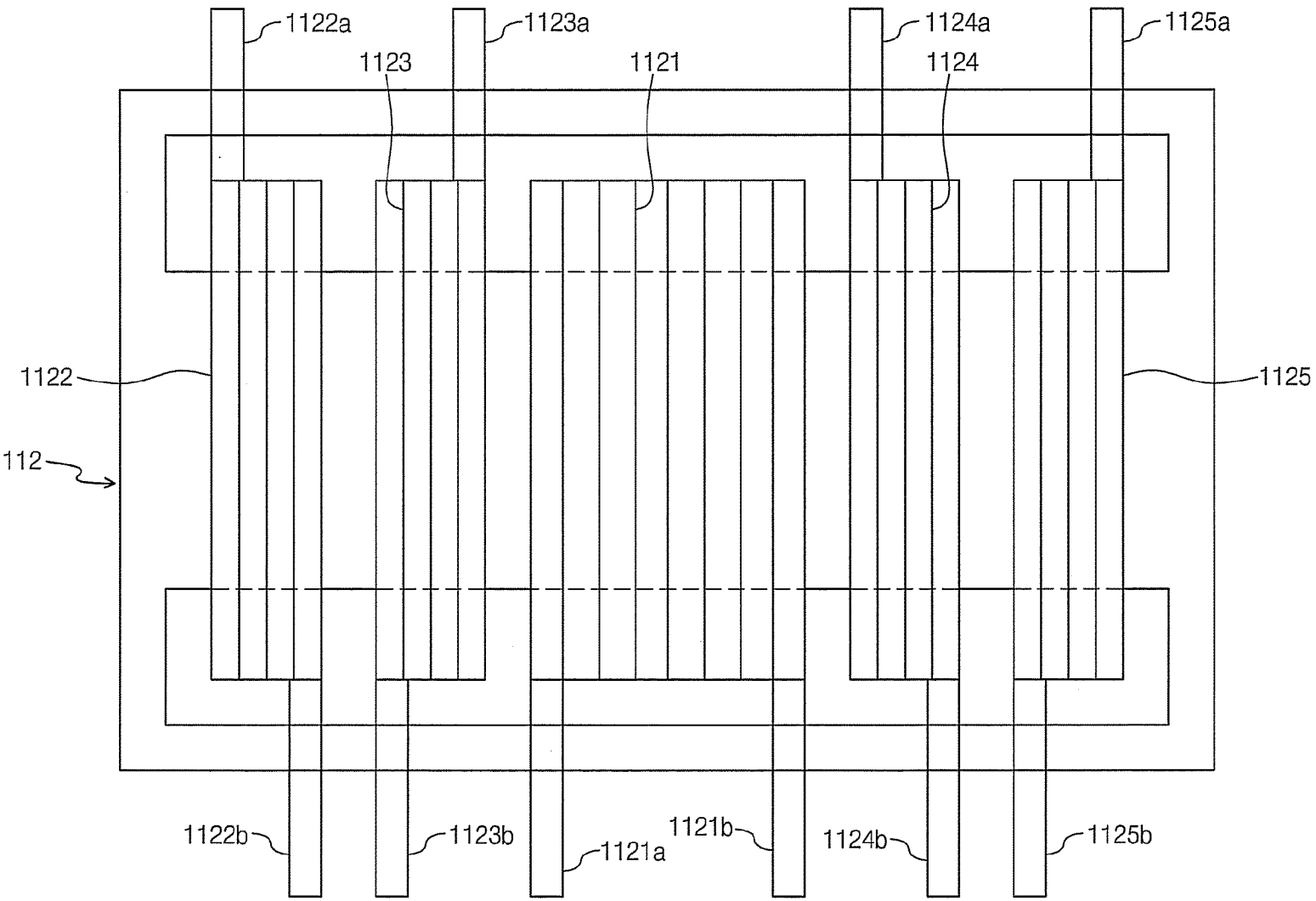
FIG. 11 is a top plan view illustrating coils of an exemplary inverter transformer in an exemplary inverter circuit and an exemplary backlight assembly according to a ninth embodiment of the present invention.
Figure 12:
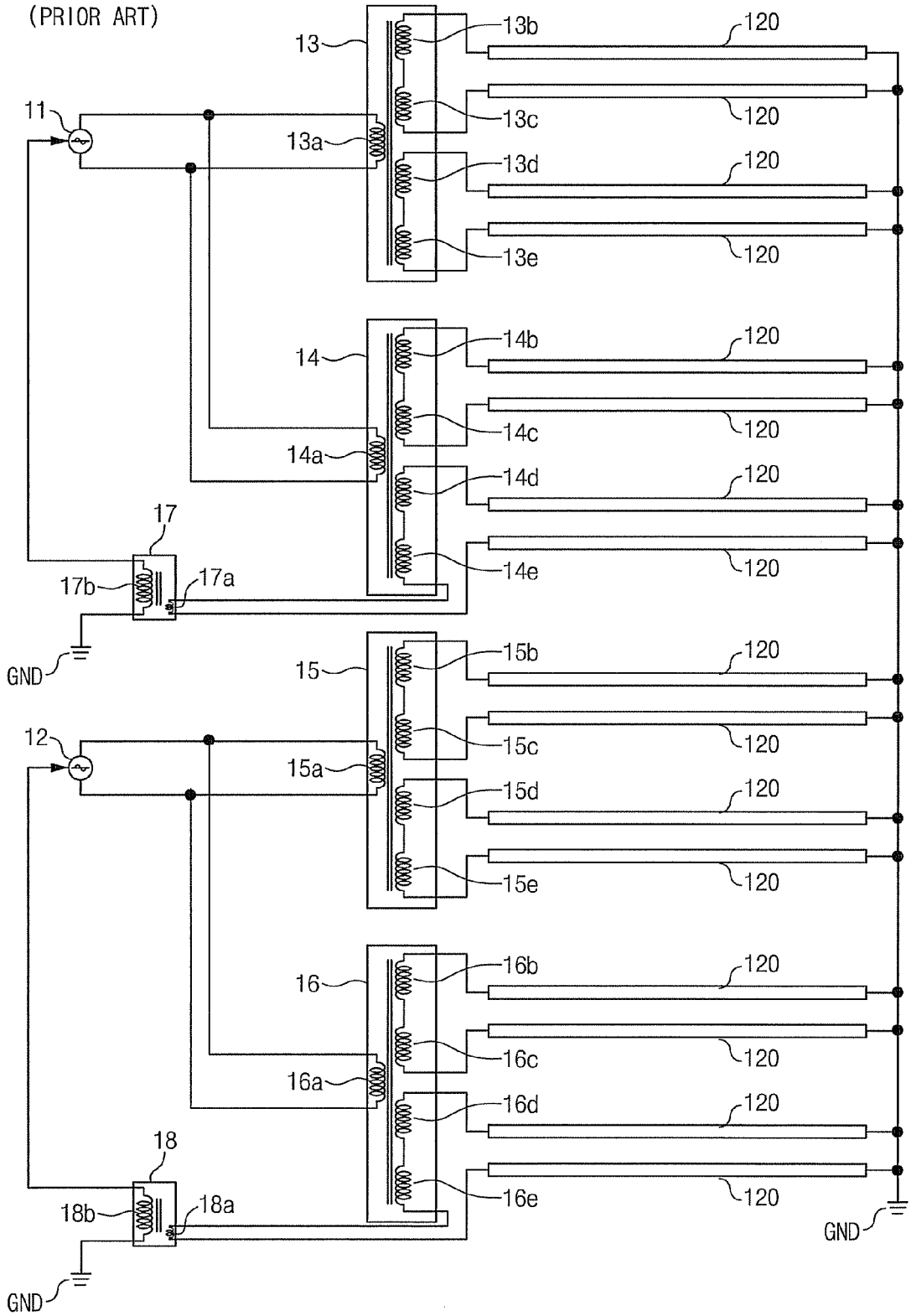
Fig. 12 (PRIOR ART)
FIG. 12 is a circuit schematic diagram illustrating a conventional inverter circuit of the prior art.

Hereinafter, a ninth exemplary embodiment of the present invention will be described in detail with reference to accompanying drawings. FIG. 11 is a top plan view illustrating a coil state of an exemplary inverter transformer of an exemplary inverter circuit and an exemplary backlight assembly according to the ninth embodiment of the present invention. The same reference numerals will be assigned to the elements identical to the elements shown in the first exemplary embodiment, and detailed description thereof will be omitted in order to avoid redundancy.

The inverter circuit and the backlight assembly include substantially the same structure as that of the first exemplary embodiment of the present invention.

Referring to FIG. 11, discharge-tube-connection pins 1122*a*, 1123*a*, 1124*a* and 1125*a* for two pairs of the secondary coils 1122, 1123, 1124 and 1125 of the inverter transformer 112 are arranged at one side of the inverter transformer 112 in order to connect to a plurality of CCFLs 120.

Further, balance-transformer-connection pins 1122*b*, 1123*b*, 1124*b* and 1125*b* for the two pairs of the secondary coils 1122, 1123, 1124 and 1125 of the inverter transformer 112 are arranged at an opposite side of the first connection pins 1122*a*, 1123*a*, 1124*a* and 1125*a* of the inverter transformer 112 in order to connect to a plurality of balance transformers 113 and 114. In addition, inverter-connection pins 1121*a* and 1121*b* for a primary coil 1121 of the inverter transformer 112 are arranged at an opposite side of the first connection pins 1122*a*, 1123*a*, 1124*a* and 1125*a* of the inverter transformer 112 in order to connect to the inverter 111.

In addition, the ninth exemplary embodiment of the present invention is adaptable for other exemplary embodiments with exception to the first exemplary embodiment.

As described above, according to the ninth exemplary embodiment of the present invention, since the balance-transformer-connection pins are arranged at an opposite side of the discharge-tube-connection pins of the inverter transformer, the balance-transformer connection pins are protected from the influence of a high voltage applied to the discharge-tube connection pins.

According to the present invention, since current flowing through the plurality of pairs of discharge tubes is uniformly maintained due to an operation of a plurality of balance transformers such that the balance transformers compensate for a shortage of a starting voltage even if the starting voltage is insufficient in a portion of the two pairs of the CCFLs. Accordingly, portions of CCFLs are prevented from being turned off. In addition, since current detection interconnections are unnecessary for secondary coils of the inverter transformer, designs of the secondary coils of the inverter transformer can be similar to each other. Further, a fault can be detected and notified. The connection pins for balance transformers can be protected from an influence of the high voltage applied to connection pins for discharge tubes.

Although some exemplary embodiments of the present invention have been described, it is understood that the present invention should not be limited to these exemplary embodiments but various changes and modifications can be made by one of ordinary skill in the art within the spirit and scope of the present invention as hereinafter claimed.

What is claimed is:

1. An inverter circuit comprising:

a power supply which outputs an alternating current high voltage;

an inverter transformer having one primary coil connected to an output terminal of the power supply and pairs of secondary coils which supply an alternating current high voltage, induced by the one primary coil, to pairs of discharge tubes; and a plurality of balance transformers having primary coils serially connected between respective pairs of the pairs of secondary coils of the inverter transformer, and having secondary coils corresponding to the primary coils of the plurality of balance transformers, wherein the secondary coils of the plurality of balance transformers are serially connected to form a loop.

2. The inverter circuit as claimed in claim 1, wherein the secondary coils of the plurality of balance transformers which form the loop are connected to a ground.

3. The inverter circuit as claimed in claim 1, wherein the power supply is provided with a current detection value based on a current value of the secondary coils of the plurality of balance transformers to control an output voltage of the power supply.

4. The inverter circuit as claimed in claim 3, further comprising a current detection transformer which has a primary coil serially connected to the secondary coils of the plurality of balance transformers and a secondary coil connected to the power supply to provide the current detection value to the power supply.

5. The inverter circuit as claimed in claim 4, further comprising a fault detection assembly which detects a fault based on the current value of the plurality of balance transformers, wherein the fault detection assembly comprises:

a plurality of tertiary coils, where each neighboring pair of tertiary coils is serially connected to each other to cause an alternating voltage generated therefrom to be offset, and a first end portion of a connection body of the paired neighboring tertiary coils is connected to the loop of the secondary coils of the plurality of balance transformers;

a diode including an input terminal connected to a second end portion of the connection body of the paired neighboring tertiary coils so as to detect a current flowing through the connection body of the neighboring paired tertiary coils to create a current value;

a fault detector connected to an output terminal of the diode so as to compare the current detection value of the diode or a voltage detection value, obtained by a conversion of the current detection value, with a reference value, determine a fault state and create a determination result; and a notification unit which notifies the determination result of the fault detector.

6. The inverter circuit as claimed in claim 5, wherein the pairs of secondary coils of the inverter transformer include first connection pins disposed at one side of the inverter transformer in order to connect to the pairs of discharge tubes, and the pairs of secondary coils of the inverter transformer include second connection pins disposed at an opposite side of the inverter transformer in order to connect to the plurality balance transformers.

7. The inverter circuit as claimed in claim 1, wherein a number of the balance transformers is calculated by multiplying a number of the paired secondary coils of the inverter transformer by a number of the inverter transformers.

8. The inverter circuit as claimed in claim 1 wherein the inverter transformer includes a first inverter transformer and a second inverter transformer connected to the power supply in parallel with each other, and the primary coils of the plurality of balance transformers are serially connected between respective pairs of the pairs of secondary coils of the first and second inverter transformers.

9. The inverter circuit as claimed in claim 8, wherein the secondary coils of the plurality of balance transformers which form the loop are connected to a ground, and the power supply is provided with a current detection value based on a current value of the secondary coils of the plurality of balance transformers to control an output voltage of the power supply.

10. The inverter circuit as claimed in claim 8, further comprising a current detection transformer having a primary coil serially connected to the secondary coils of the plurality of balance transformers, and a secondary coil connected to the power supply to provide the current detection value to the power supply.

11. The inverter circuit as claimed in claim 8, wherein a number of the plurality of balance transformers is obtained by multiplying a number of the paired secondary coils of the inverter transformer by a number of the inverter transformers.

12. The inverter circuit as claimed in claim 1 wherein the power supply includes a first power supply and a second power supply, and the inverter transformer includes a first inverter transformer and a second inverter transformer, and wherein the first power supply outputs a first alternating current voltage, the second power supply outputs a second alternating current voltage, the first inverter transformer has one primary coil connected to an output terminal of the first power supply and pairs of secondary coils which supply a first alternating current high voltage, induced by the primary coil, to pairs of discharge tubes, the second inverter transformer has one primary coil connected to the output terminal of the second power supply and pairs of secondary coils which supply a second alternating current high voltage, induced by the primary coil, to pairs of discharge tubes, and the primary coils of the plurality of balance transformers are serially connected between respective pairs of the pair of secondary coils of the first and second inverter transformers.

13. The inverter circuit as claimed in claim 12, wherein the secondary coils of the plurality of balance transformers which form the loop are connected to a ground, and the first and second power supplies are each provided with a current detection value based on a current value of the secondary coils of the plurality of balance transformers to control an output voltage of each of the first and second power supplies.

14. The inverter circuit as claimed in claim 13, further comprising a current detection transformer including a primary coil serially connected to the secondary coils of the plurality of balance transformers, and a secondary coil connected to the first and second power supplies to provide the current detection value based on the current value of the secondary coils of the plurality of balance transformers to the first and second power supplies.

15. The inverter circuit as claimed in claim 14, further comprising a fault detection assembly which detects a fault based on the current value of the plurality of balance transformers, wherein the fault detection assembly comprises:

a plurality of tertiary coils, where each neighboring pair of tertiary coils is serially connected to cause alternating voltages generated therefrom to be offset, and a first end portion of a connection body of the paired neighboring tertiary coils is connected to the loop of the secondary coils of the plurality of balance transformers;

a diode including an input terminal connected to a second end portion of the connection body of the paired neighboring tertiary coils to detect a current flowing through the connection body of the paired tertiary coils to create a current value;

a fault detector connected to an output terminal of the diode so as to compare the current detection value of the diode or a voltage detection value, obtained by a conversion of the current detection value, with a reference value, determine a fault state and create a determination result; and a notification unit which notifies the determination result of the fault detector.

16. The inverter circuit as claimed in claim 15, wherein the pairs of the secondary coils of the inverter transformer include first connection pins disposed at one side of the inverter transformer in order to connect to the pairs of discharge tubes, and the pairs of the secondary coils of the inverter transformer include second connection pins disposed at an opposite side of the inverter transformer in order to connect to the plurality of balance transformers.

17. A backlight assembly comprising:

a plurality of discharge tubes;

a power supply which outputs an alternating current voltage;

an inverter transformer having one primary coil connected to an output terminal of the power supply and pairs of secondary coils which supply an alternating current high voltage, induced by the primary coil, to pairs of the discharge tubes; and a plurality of balance transformers having primary coils serially connected between respective pairs of the pairs of secondary coils of the inverter transformer and secondary coils corresponding to the primary coils of the plurality of balance transformers, wherein the secondary coils of the plurality of balance transformers are serially connected to form a loop.

18. The backlight assembly as claimed in claim 17, wherein the secondary coils of the plurality of balance transformers which form the loop are connected to a ground.

19. The backlight assembly as claimed in claim 17, wherein the power supply is provided with a current detection value based on a current value of the secondary coils of the plurality of balance transformers to control an output voltage of the power supply is controlled.

20. The backlight assembly as claimed in claim 19, further comprising a current detection transformer having a primary coil serially connected to the secondary coils of the plurality of balance transformers, and a secondary coil connected to the power supply to provide the current detection value based on the current value to the power supply.

* * * * *